US010119100B2

(12) United States Patent
Ewell et al.

(10) Patent No.: US 10,119,100 B2
(45) Date of Patent: Nov. 6, 2018

(54) LAUNDRY DETERGENT COMPOSITIONS

(71) Applicant: The Honest Company, Inc., Los Angeles, CA (US)

(72) Inventors: Kevin Ewell, Simi Valley, CA (US); Carolyn Shawn Murphy, Harrison, OH (US); Bradley J. Barron, Los Angeles, CA (US); Christopher Gavigan, Santa Monica, CA (US)

(73) Assignee: The Honest Company, Inc., Los Angeles, CA (US)

( * ) Notice: Subject to any disclaimer, the term of this patent is extended or adjusted under 35 U.S.C. 154(b) by 0 days.

(21) Appl. No.: 15/479,977

(22) Filed: Apr. 5, 2017

(65) Prior Publication Data

US 2017/0292088 A1 Oct. 12, 2017

Related U.S. Application Data

(60) Provisional application No. 62/319,681, filed on Apr. 7, 2016.

(51) Int. Cl.

| | |
|---|---|
| ***C11D 1/00*** | (2006.01) |
| ***C11D 3/00*** | (2006.01) |
| ***C11D 11/00*** | (2006.01) |
| ***C11D 3/20*** | (2006.01) |
| ***C11D 3/10*** | (2006.01) |
| ***C11D 3/04*** | (2006.01) |
| ***C11D 1/66*** | (2006.01) |
| ***C11D 1/12*** | (2006.01) |
| ***C11D 1/83*** | (2006.01) |

(52) U.S. Cl.

CPC ..... *C11D 3/0026* (2013.01); *C11D 1/126* (2013.01); *C11D 1/662* (2013.01); *C11D 1/83* (2013.01); *C11D 3/046* (2013.01); *C11D 3/10* (2013.01); *C11D 3/2041* (2013.01); *C11D 3/2065* (2013.01); *C11D 11/0017* (2013.01)

(58) Field of Classification Search

None

See application file for complete search history.

(56) References Cited

U.S. PATENT DOCUMENTS

| | | | | |
|---|---|---|---|---|
| 6,017,871 A * | 1/2000 | Baeck | ..... | A61K 8/22 510/125 |
| 2008/0131393 A1* | 6/2008 | Yeung | ..... | A61K 8/90 424/70.11 |

* cited by examiner

*Primary Examiner* — Necholus Ogden, Jr.

(74) *Attorney, Agent, or Firm* — Tutunjian & Bitetto, P.C.

(57) ABSTRACT

A laundry detergent composition including an alkyl isethionate and a de-foaming agent.

19 Claims, No Drawings

LAUNDRY DETERGENT COMPOSITIONS

CROSS REFERENCE TO RELATED APPLICATIONS

This application claims priority to U.S. Provisional Patent Application Ser. No. 62/319,681 filed on Apr. 7, 2016, the entire contents of which is incorporated herein by reference.

BACKGROUND

1. Technical Field

The present disclosure relates to laundry detergent compositions, and more particularly to laundry detergent compositions that include isethionates as a surfactant.

2. Description of the Related Art

Laundry detergents include surfactants, which are ions or molecules that include polar and nonpolar components. The polar component, e.g., the hydrophilic component, allows the detergent to dissolve in water, whereas the nonpolar component, which is hydrophobic, solubilizes oils, greases, and other polar hydrophobic materials that cause stains and which are to be removed in the laundry cleaning process.

Alkyl benzenesulfonates, e.g., branched and linear alkyl benzenesulfonates (ABS), are surfactants that are used in commercially-available laundry detergents. ABS surfactants may be used in combination with other surfactants such as alkyl ethoxylated surfactants (AES) and methyl ester sulfonate (MES) surfactants. These surfactants are not suitable for use in the natural or green segment of the home care product industry, as there are concerns about whether they are harmful to the environment.

Yet another concern with the alkyl benzenesulfonates and other surfactants is their tendency to irritate sensitive skin. There are many adult individuals predisposed to suffer from such irritation. Babies and infants are particularly likely to suffer from skin irritations due to the residue of a harsh cleaning agent that was used to wash their clothing. These persons are best served by using laundry detergents specially formulated with non-harmful ingredients that are gentle and non-irritating to skin.

In the green or natural segment of the laundry detergent product offerings, alkyl polyglycosides (APGs) such as alkyl polyglucosides (when the saccharide moiety is glucose) are used because they are naturally derived surfactants. The APGs are gentle and non-irritating to skin and do not contain products deemed unacceptable by reason of containing ethoxylated sulfates and other undesirable components.

However, APGs are non-ionic surfactants, and APG-containing laundry detergents do not exhibit the cleaning power of a detergent that includes an anionic surfactant. APGs are less soluble in hot water than anionic surfactants, which may affect their ability to clean under those laundry conditions.

Isethionates are a class of surfactant compounds sometimes found in cleaning agents used in personal care products; however when added to aqueous environments they tend to foam excessively, which makes them unsuited for use in a laundry detergent composition. The agitation that takes place in a washing machine may contribute to foam generation. Excessive foam may create a messy situation due to foam overflow from the machine. It may also make it difficult to completely empty the foam from the machine, and may damage machines that are not designed to handle large amounts of foam.

SUMMARY

A laundry detergent composition including an alkyl isethionate and a de-foaming agent.

A laundry detergent composition, including, an alkyl isethionate in the range of about 0.1 wt. % to about 99.5 wt. %, and one or more de-foaming agent(s) in the range of about 0.1 wt. % to about 10% wt. % of the composition.

A method of preparing a laundry detergent composition, including, heating deionized water to about 60° C. in a mixing vessel, and adding a fatty alcohol ethoxylate, an alkyl isethionate, glycerol, a coconut fatty acid, a propanediol, and calcium chloride to the heated deionized water in the vessel.

The alkyl isethionate can be selected from the group consisting of sodium lauroyl methyl isethionate, ammonium cocoyl isethionate, sodium cocoyl isethionate, sodium hydrogenated cocoyl methyl isethionate, sodium lauroyl isethionate, sodium myristoyl isethionate, sodium oleoyl isethionate, sodium oleoyl methyl isethionate, sodium palm kerneloyl isethionate, sodium stearoyl methyl isethionate, sodium isethionate, dibromopropamidine diisethionate, hexamidine diisethionate, sodium methyl isethionate, and combinations thereof.

These and other features and advantages will become apparent from the following detailed description of illustrative embodiments thereof.

DETAILED DESCRIPTION

Isethionates are a class of anionic surfactants, characterized by the presence of a sulfonic acid group (—$SO_2OH$). Isethionate surfactants may be used in personal cleaning agents such as shampoos and body cleansers because they are gentle on skin (i.e., are non-irritating), and are compatible with hard water. Isethionate-including laundry detergent compositions are gentle and non-irritating to the skin of a person. Since they are anionic they provide good cleaning power, at least when compared to the non-ionic surfactant-containing laundry detergents. Isethionate-containing compositions foam and lather in a manner similar to the way soap foams in soft water, and this foaming occurs even when they are used in hard water. However, because isethionate-containing compositions may generate large amounts of foam, they have not been used as laundry detergent compositions. Excessive foaming may damage a washing machine or otherwise generate so much foam as to cause a mess or make it difficult to clear the machine of the foam. One may have to run additional rinse cycles on the machine just to rid it of the foam that has accumulated.

Principles and embodiments of the present invention generally relate to stable laundry detergent compositions including one or more alkyl isethionates (e.g., R—$OCH_2CH_2SO_3^-M^+$) as surfactants (e.g., sodium 2-(dodecanoyloxy)propane-1-sulfonate), which do not foam excessively in a wash cycle.

A stable laundry detergent can have a three year shelf-life in which there is no or minimal change in the product's viscosity, color, odor, pH, and general appearance (e.g., haziness/cloudiness). A laundry detergent composition may have a pH in the range of about 4.0 to about 6.0. A liquid laundry detergent composition may have a viscosity in the range of about 1000 centipoises (cps) to about 10,000 cps.

The specific gravity of the liquid laundry detergent composition may be 0.98 to 1.01. The color of the laundry detergent composition can be from clear to a light straw color. The general appearance of the laundry detergent composition can be a translucent viscous liquid, where the laundry detergent composition is not an anhydrous powder.

Principles and embodiments of the present invention described herein are directed to laundry detergent compositions that include one or more isethionates as surfactants in stable compositions that include de-foaming agents (also referred to as foam-reducing agents). The presence of the de-foaming agents, if not completely eliminating foam generation, reduce it to an acceptable level that does not impair the operation of a washing machine. The laundry detergent compositions, which in addition to including water (e.g., deionized (DI) water), include one or more isethionates as surfactants and foam-reducing components that can limit the amount of foam that is generated by the isethionates.

In one or more embodiments, a laundry detergent composition may include an alkyl isethionate and a de-foaming agent with the balance including deionized water to provide an aqueous composition. A laundry detergent composition may have 0% to about 95% DI $H_2O$. In an aqueous-based (i.e., liquid) laundry detergent composition, the DI $H_2O$ can make up about 6% to about 94%, or about 10% to about 50%, or about 50% to about 90% by weight of the product composition, although other weight-percentages are contemplated. In various embodiments, the deionized (DI) water can be excluded (e.g., $H_2O$<1 wt. %) to form a dry mixture (i.e., anhydrous powder) of a laundry detergent. In a dry composition (i.e., powder laundry detergent), the alkyl isethionate and a de-foaming agent can be up to 100% of the composition, and DI water can be 0%.

Alkyl isethionates, which can be fatty acyl isethionates, are suited for use as the isethionate surfactant of the laundry detergent compositions. Fatty acyl isethionates are the reaction products of sodium isethionate (the sodium salt of 2-hydroxyethanesulfonic acid) and aliphatic fatty acids having saturated or unsaturated hydrocarbon chains including 7 to 28 carbon atoms, or 8 to 22 carbon atoms, or 10 to 18 carbon atoms, or 12-14 carbon atoms. Side chains can be methyl ($CH_3$—) or ethyl ($CH_3CH_2$—).

In one or more embodiments, the isethionate can be an alkyl isethionate R—$OCH_2CH_2SO_3^-$ $M^+$), where the length of the carbon chain of the R group is in the range of $C_7$ to $C_{28}$, or in the range of $C_8$ to $C_{22}$, or in the range of $C_{10}$ to $C_{18}$, or in the range of $C_8$ to $C_{16}$, where the R— group can be a branched or straight chain aliphatic moiety.

Other hydroxyalkanesulfonic acids may be employed in forming fatty acyl isethionates, e.g., hydroxypropanesulfonic acid and hydroxybutanesulphonic acid. Further, alkali metal salts of 2-hydroxyalkanenesulfonic acids other than the sodium salts may be employed in producing fatty acyl isethionates, and other non-alkali metal salts, such as ammonium salts, may also be employed.

In one or more embodiments, the alkyl isethionate can be selected from the group consisting of sodium lauroyl methyl isethionate, ammonium cocoyl isethionate, sodium cocoyl isethionate, sodium hydrogenated cocoyl methyl isethionate, sodium lauroyl isethionate, sodium myristoyl isethionate, sodium oleoyl isethionate, sodium oleoyl methyl isethionate, sodium stearoyl methyl isethionate, sodium isethionate, dibromopropamidine diisethionate, hexamidine diisethionate, sodium methyl isethionate, and combinations thereof.

Additional alkyl and fatty acyl isethionates that may be used as surfactants in the laundry detergent compositions include sodium palm kerneloyl isethionate.

Other isethionates may be used as the surfactant. Mixtures of a fatty acyl isethionate and another kind of isethionate may also be employed as a surfactant combination in the laundry detergent compositions.

Alkyl and fatty acyl isethionates may exist in mixtures that contain other components, such as free fatty acids and/or fatty acid salts and/or hydroxyalkanesulfonic acids, e.g., sodium isethionate. Fatty acyl isethionate mixtures may include several different fatty acyl isethionate species differing, for example, in the length of the saturated or unsaturated hydrocarbon chain length.

Alkyl and fatty acyl isethionates and other isethionates are commercially available products. For example, sodium lauroyl methyl isethionate is available under the trade name ISELUX® LQ-CLR from Innospec, Inc., Littleton Colo.

In one or more embodiments, the laundry detergent composition may include a fatty acyl isethionate component in the range of about 0.1 wt. % to about 99.5 wt. % of the composition, where the fatty acyl isethionate component may include one or more fatty acyl isethionate(s). In various embodiments, the laundry detergent composition may be about 4 wt. % to about 99 wt. %, or about 5 wt. % to about 95 wt. %, or about 5 wt. % to about 90 wt. %, or about 10 wt. % to about 50 wt. %, or about 15 wt. % to about 25%, or about 50 wt. % to about 90 wt. % alkyl isothionate(s), including fatty acyl isethionate(s).

In one or more embodiments, the de-foaming agent can be $C_2$-$C_{30}$ substituted or unsubstituted diols, $C_2$-$C_{30}$ substituted or unsubstituted triols, $C_2$-$C_4$ alcohols, a soluble chloride or carbonate salt, or combinations thereof.

In one or more embodiments, the de-foaming agent can be selected from the group consisting of $C_2$-$C_5$ substituted or unsubstituted diols (e.g., ethane-1,2-diol (i.e., ethylene glycol), 1,3-propanediol, 1,2-propanediol, 1,4-butanediol, 1,2-butanediol, 2-methyl pentane 2,4-diol, etc.), $C_2$-$C_5$ substituted or unsubstituted triols (e.g., 1,2,3-propane triol (i.e., glycerol, glycerin)), 1,1,2-propanetriol, 2-methyl-1,2,3-propanetriol, 1,2,4-butanetriol, etc.), erythritol (i.e., butane-1,2,3,4-tetraol), $C_2$-$C_4$ primary and secondary alcohols (e.g., ethanol, propanol, isopropanol, butanol), soluble chloride salts (e.g., NaCl, KCl, $MgCl_2$, $CaCl_2$), carbonate salts (e.g., $NaCO_3$, $KCO_3$), and combinations thereof. The salts may be soluble, non-toxic, alkali metal or alkaline earth metal salts, for example, sodium carbonate ($Na_2CO_3$) or calcium chloride ($CaCl_2$) (e.g., $CaCO_3$. would not be included due to solubility limits, barium chloride ($BaCl_2$) would not be included due to toxicity). In various embodiments, toxic diols, triols, and salts may be excluded from the group of de-foaming agents. The de-foamers may all be certified as safe by the FDA and/or EPA.

In one or more embodiments, the de-foaming agent can be selected from the group consisting of $C_2$-$C_5$ substituted or unsubstituted diols, $C_2$-$C_5$ substituted or unsubstituted triols, $C_2$-$C_4$ primary and secondary alcohols, soluble, non-toxic, chloride salts, soluble, non-toxic, carbonate salts, and combinations thereof.

In one or more embodiments, the de-foaming agent can be selected from the group consisting of ethane-1,2-diol (i.e., ethylene glycol), 1,3-propanediol, 1,2-propanediol, 1,4-butanediol, 1,2-butanediol, 2-methyl pentane 2,4-diol, 1,2,3-propane triol (i.e., glycerol, glycerin)), 1,1,2-propanetriol, 2-methyl-1,2,3-propanetriol, 1,2,4-butanetriol, butane-1,2,3,4-tetraol, and combinations thereof.

In various embodiments, in addition to glycerin, propanediol, sodium carbonate, and calcium chloride, other possible de-foaming agents that may be included in the detergent compositions are $C_3$ to $C_{10}$ diols (other than propanediol), $C_{14}$ to $C_{30}$ diols, $C_3$ to $C_{10}$ alcohols, such as for example, isopropyl alcohol, ethyl alcohol, phenyl trimethicone (i.e., phenyl-tris(trimethylsilyloxy)silane), ethyl hydroxymethyl oleyl oxazoline, polypropylene glycol (propane-1,2-diol), amino-substituted silicones, silicone polymer complex and polydimethyl siloxane (PDMS) in a solvent, e.g., a pentamer solvent. Suitable $C_3$ to $C_{10}$ alkyl diols other than propanediol include butylene glycol, propylene glycol, pentylene glycol, hexylene glycol, and decylene glycol.

In one or more embodiments, the laundry detergent composition may include a de-foaming agent in the range of about 0.1 wt. % to about 10% wt. % of the composition, where there may be one or more de-foaming agents included. In various embodiments, the laundry detergent composition may be about 0.1 wt. % to about 5% wt. %, or about 1% wt. % to about 3 wt. %, or about 5% wt. % to about 50 wt. % de-foaming agent. The weight-percentage of de-foaming agent can be proportional to the weight-percentage of alkyl and/or fatty acyl isethionate, where the ratio of alkyl and/or fatty acyl isethionate to de-foaming agent can be in the range of about 50:1 to about 1:2, or in the range of about 50:1 to about 1:1, or in the range of about 10:1 to about 2:1.

In various embodiments, sodium carbonate ($NaCO_3$) may also be included as a detergent builder in the composition, such that the weight percentage of $NaCO_3$ may be higher than the maximum weight percentage of de-foamer alone.

In non-limiting exemplary embodiments, a laundry detergent composition includes at least one of each a fatty acyl isethionate, a glycerin, a diol, and a soluble chloride or carbonate salt (e.g., NaCl, KCl, $MgCl_2$, $CaCl_2$, $Na_2CO_3$, $K_2CO_3$).

In one or more embodiments, detergent builder materials may be included in laundry detergent composition, where the detergent builder materials can be fatty acids and salts thereof having a carbon chain length in the range of about $C_{10}$ to about $C_{22}$. Suitable saturated fatty acids can be obtained from natural sources such as plant esters (e.g., palm kernel oil, palm oil and coconut oil).

In various embodiments, the fatty acid or salt thereof can be cocoyl sarcosine, lauroyl sarcosine, myristoyl sarcosine, oleoyl sarcosine, stearoyl sarcosine, sodium cocoyl sarcosinate, sodium lauroyl sarcosinate, sodium myristoyl sarcosinate. sodium oleoyl sarcosinate, or sodium stearoyl sarcosinate.

Detergent builder materials may be included in amount of about 1% to about 75% by weight, or about 1% to about 50% by weight (e.g., for concentrated formulas (e.g., powder laundry detergent)), or about 1% to about 10% by weight, or about 1% to about 5% by weight (e.g., for a liquid laundry detergent).

In various embodiments, the laundry detergent composition may further include a fatty alcohol ethoxylate ($RO—(CH_2CH_2O)_n—H$), a fatty acid, for example, coconut fatty acid (e.g., $C_{10}$-$C_{16}$ fatty acid blends, typically formed from coconut oils), a cleaning enzyme, or combinations thereof.

Other ingredients may be included in the laundry detergent composition. For example, detergent builders such as sodium carbonate may be included.

In various embodiments, a laundry detergent composition may also include one or more additional surfactants, one or more additional cleaning enzymes, one or more additional isethionates, one or more preservatives, one or more stabilizers, one or more thickeners, one or more fragrances, and/or one or more colorants.

In one or more embodiments, the laundry detergent composition may include one or more non-ionic or amphoteric surfactants (e.g., alkyl betaines, ethylene oxide/poly ethylene glycol compounds (e.g., PEG 150, etc.) as solublizers. The non-ionic or amphoteric surfactants can be alcohols and/or diols, which may also act as de-foamers.

In one or more embodiments, the laundry detergent composition may be about 0.01 wt. % to about 48 wt. % additional surfactant(s), where the additional surfactants may include one or more surfactant(s). The weight-percentage of additional surfactant can be proportional to the weight-percentage of alkyl isethionate, where the ratio of alkyl isethionate to additional surfactant can be in the range of about 1000:1 to about 1:1, or in the range of about 500:1 to about 5:1, or in the range of about 100:1 to about 10:1. The ratio of additional surfactant(s) to fatty acyl isethionate can be less than 1:1 (e.g., 1:1.01, 1:2, etc.), such that the fatty acyl isethionate is the majority surfactant component in the laundry detergent composition, where the weight of fatty acyl isethionate can be greater than the combined weight of all other non-fatty acyl isethionate surfactants.

In one or more embodiments, anti-redeposition agents (e.g., carboxymethyl cellulose) may be included.

In one or more embodiments, thickening agents, for example, xanthan gum and preservatives such as potassium sorbate, sodium benzoate, and gluconolactone, may be included in the composition.

In one or more embodiments, a chelating agent (e.g., ethylene diamine-tetraacetic acid (EDTA)) may be included in the composition.

In one or more embodiments, de-caking agents (e.g., magnesium stearate, calcium stearate, calcium silicate, stearic acid, etc.) may be included in an anhydrous powder laundry detergent composition. In various embodiments, the de-caking agent is not a basic compound (e.g., sodium bicarbonate), so does not increase the pH of the laundry detergent composition above 7.0.

In one or more embodiments, the laundry detergent composition does not include ammonium compounds, amides, boric acid salts, alkali metal hydroxides, or alkaline earth metal hydroxides. The laundry detergent composition does not include industrial de-foamers (i.e., de-foamers not certified as safe for personal products; e.g., by FDA or listed in inventory under the Toxic Substances Control Act (TSCA)).

In a non-limiting exemplary embodiment, the laundry detergent composition includes DI water, an alkyl isethionate surfactant, and one or more foam-reducing agents. For example, the one or more de-foaming agents may be glycerin, sodium carbonate, calcium chloride, and propanediol, from among other possible foam-reducing agents.

In one or more embodiments, the laundry detergent composition may include foam-reducing components that can be diols, triols, soluble salts, and combinations thereof, where the triol may be glycerin (propane-1,2,3-triol), the diol may be propanediol (1,3-propanediol). In various embodiments, the laundry detergent composition may include a combination of glycerin, propanediol, and calcium chloride or sodium carbonate.

It has been found that isethionate-containing laundry detergent compositions including one or more of foam-reducing components generate significantly less foam than isethionate-containing laundry detergent compositions that do not include a foam-reducing component. The compositions that include foam reducing components (i.e., de-foaming agents) may in some instances exhibit a greater than 50% reduction in foaming, as determined by measuring the height of the foam above the liquid level. The isethionate-containing laundry detergent compositions in accordance with the present principles exhibit significantly reduced foaming and thus effective isethionate-including laundry detergent compositions are now provided.

The inclusion of other cleaning agents, for example enzymes such as protease, amylase, lipase and pectinase, improve the cleaning power of the laundry detergent composition. Cleaning enzymes may be included in the composition for breaking down particular biological compounds forming difficult to remove stains, as these enzymes work on tough stains such as food, grass and dirt stains.

Other surfactants may be included in the composition, such as for example, fatty alcohol ethoxylates, cationic surfactants (e.g., amines, alkylimidazolines, quaternized ammonium compounds), amphoteric or zwitterionic surfactants (e.g., sodium lauriminodipropionate, disodium auroamphodiacetate), non-ionic surfactants (alcohols, alkanolamides, esters, and amine oxides), and alkyl polyglucosides (APGs).

In one embodiment in accordance with present principles, the laundry detergent composition has a pH of less than 7.0 but not lower than 4.0. The composition may include a weak organic acid, such as citric acid, as a pH adjuster/buffer. The weak organic acid(s) may be present in an amount sufficient to adjust pH to below 7.0, or in the range of less than 7.0 but not lower than 4.0, or in the range of 4.0 to about 6.0, or in the range of 4.2 to 5.8, where the pH is measured at a temperature of 25° C.

To improve the cleaning power of the detergent compositions, the composition may include one or more enzymes that break down and remove tough stains, where the enzyme(s) can be selected from the group consisting of proteases, amylases, pectinases, lipases, and combinations thereof, which respectively act on proteins, starches, pectins and fats. The enzymes may also break down and remove stain-causing bacteria. The inclusion of enzymes in the laundry detergent compositions may improve the cleaning performance of the compositions in cold water washes, thereby allowing a reduction in energy consumed by the washing machine and to realize a cost savings in the process.

In various embodiments, the detergent compositions may further include preservatives and stabilizers, for example potassium sorbate, sodium benzoate, and gluconolactone.

In one or more embodiments, thickeners such as polysaccharides (e.g., xanthan gum, guar gum, gum arabic, agar, etc.) and gells (e.g., poly(acrylic acid), i.e., carbomer gells) may be included in the compositions to increase the composition viscosity, which may aid in controlling the pour of the composition so that only a desired amount is dispensed from the composition packaging.

In various embodiments, the laundry detergent composition may have a viscosity in the range of about 1,000 cps to about 10,000 cps, or in the range of about 1,500 cps to about 7,500 cps, or in the range of about 2,000 cps to about 4,000 cps, although other viscosities are also contemplated. The viscosity can be measured using a Brookfield spindle viscometer, model#DV-2-II, using an RV-03 spindle rotating at 100 rpm, where the measurements are taken at 25° C. The same measurement apparatus and techniques can be used for determining the viscosity stability of the laundry detergent composition.

In various embodiments, the specific gravity of the liquid laundry detergent composition may be 0.98 to 1.01.

In a non-limiting exemplary embodiment, the detergent composition includes, water, an isethionate and one or more foam-reducing agents. The one or more de-foaming agents (also referred to as foam reducing agents) comprise one or more of the following: glycerin; propanediol; sodium carbonate; calcium chloride; a $C_3$ to $C_{10}$ glycol other than propanediol; a $C_{14}$ to $C_{30}$ glycol; isopropyl alcohol; ethyl alcohol; dimethicone; phenyl trimethicone; ethyl hydroxymethyl oleyl oxazoline, polypropylene glycol, amino-substituted silicones, silicone polymer complex and polydimethyl siloxane in a pentamer solvent.

In a non-limiting exemplary embodiment, the detergent composition includes, by weight, about 5% to about 25% sodium lauroyl methyl isethionate; about 0.1% to about 10% glycerin; about 0.01% to about 5% propanediol; about 0.5% to about 5% potassium carbonate, about 0.01% to about 2.5% calcium chloride; and about 0.1 to about 10% enzymes (e.g., protease, amylase, pectinase, lipase).

In another non-limiting exemplary embodiment, in accordance with the present principles, the detergent composition includes, by weight, about 15% to about 20% sodium lauroyl methyl isethionate; about 1% to about 5% glycerin; about 0.01 to about 1% propanediol; about 1.5% to about 3.5% potassium carbonate, about 0.01 to about 0.5% calcium chloride; and about 0.1 to about 5% enzymes (e.g., protease, amylase, pectinase, lipase).

The laundry detergent composition may include fragrances or colorants to provide color to the composition and to provide it with a pleasant odor. Fragrances may include natural or synthetic aromatic compounds. A non-exclusive list includes parfum fragrance, essential oils, aromatic extracts, or aromatic compounds (e.g., eugenol, hydroxy citronella, amyl cinnamic aldehyde, coumarin, geraniol, linalool, citronellal, hexyl cinnamic aldehyde, methyl salicylate, acetyl propionyl, allyl caproate, allyl heptoate, isoamyl acetate, isovaleraldehyde, and linalyl acetate). Fragrances may be included in amounts of about 0.1% to about 10.0%.

Colorants may also be included in the compositions. In one embodiment, colorants include certified and exempt colorants and natural color additives. A non-exclusive list of colorants includes: FD & C Red 40, Red 17, FD & C Yellow 5, Yellow 4, Yellow 6, Yellow 3, FD & C Blue 1, Blue 2, FD & C Red 3, Red 14, FD & C Green 3, annatto oil, buriti oil, caramel color, carmine, chlorophyll, beet juice, red cabbage extract, iron oxides, mica, carbon black. Colorants may be present in the compositions in amounts of about 0.001% to about 10.0% by weight.

The laundry detergent compositions may be prepared by heating DI water in a vessel and adding the components with stirring to insure the mixture is homogeneous. With time, as the components hydrate, the composition thickens. The components may be added sequentially or in groups of components. The laundry detergent mixtures are cooled during the process, such as before adding the enzymes to the composition.

The following examples are directed to exemplary detergent compositions and demonstrate the foam-reducing properties that they exhibit.

Example 1

A laundry detergent composition in accordance with the present principles has the following composition and was prepared as indicated below in Table 1:

TABLE 1

| | Component | Wt. % |
|---|---|---|
| 1 | Deionized water | 84.3 |
| 2 | Fatty Alcohol Ethoxylates | 2.5 |
| 3 | Sodium Lauroyl Methyl Isethionate | 5.75 |
| 4 | Glycerin | 2.0 |

TABLE 1-continued

| | Component | Wt. % |
|---|---|---|
| 5 | Coconut Fatty Acid | 2.0 |
| 6 | Propanediol | 0.75 |
| 7 | Calcium Chloride | 0.1 |
| 8 | Enzymes: Protease, Amylase, Pectinase, Lipase | 1.5 |
| 9 | Potassium Sorbate | 0.2 |
| 10 | Sodium Benzoate (33% solution) | 0.39 |
| 11 | Gluconolactone | 0.4 |
| 12 | Citric Acid | 0.1 |
| | TOTAL | 100 |

The deionized water is added to the mixing vessel and heated to about 60° C. (140° F.). Components 2 through 7 are sequentially added to the vessel while mixing often to insure that the mixture is homogeneous before adding the next component. After these components are added and a homogenous mixture is obtained, the mixture is cooled to about 35° C. (95° F.). When that temperature is reached, ingredients 8-11 are added sequentially, insuring proper mixing to obtain a homogeneous mixture before adding the next component. The addition of citric acid adjusts the pH of the laundry detergent composition to less than 7.0.

Example 2

Another laundry detergent composition in accordance with the present principles has the following composition and was prepared as indicated below in Table 2:

| Component | Example 2 (wt. %) |
|---|---|
| Deionized water | 86.65 |
| Glycerin[1] | 2.0 |
| Xanthan Gum[2] | 0.5 |
| Anionic Surfactant[3] | 0.9 |
| Sodium Lauroyl Methyl Isethionate[4] | 5.75 |
| Propanediol[5] | 0.75 |
| Sodium Carbonate[6] | 2.0 |
| Enzymes[7] | 1.5 |
| Component Totals | 100 |

[1]Glycerin is available under the trade name SUPEROL KNP ® Glycerin 99.7%, from Proctor & Gamble Chemicals, Inc. Cincinnati OH.
[2]Xanthan gum is available under the trade name VANZAN NF ® from Vanderbilt Chemicals, LLC, Norwalk CT.
[3]The anionic surfactant is sodium myristoyl sarcosinate, available under the trade name MODIFY CLARITY ® LQ, from Croda, Inc., Edison, N.J.
[4]Sodium Lauroyl Methyl Isethionate is available under the trade name ISELUX ® LQ-CLR from Innospec, Inc., Littleton CO.
[5]Propanediol is available under the trade name ZEMEA ® from Dupont Tate & Lyle BioProducts Company, LLC, Loudon TN.
[6]Sodium Carbonate is available from Choice.
[7]Protease, amylase, pectinase and lipase are the enzymes. They are available under the tradename NOVOZYMES MEDLEY PURE ® from J Tech Sales, LLC, Boca Raton FL.

The deionized water is added to a mixing vessel equipped with turbine mixing action. Water heating begins. The temperature is raised to a target of 48.9° C.±2.8° C. (120° F.±5° F.).

Glycerin and propanediol are added to a separate vessel, and then xanthan gum is added slowly. The mixture thickens with hydration of the xanthan gum.

Sodium carbonate is added to the deionized water as it heats. Mixing occurs to dissolve the sodium carbonate in the water.

When the target temperature is reached, the glycerin/propanediol/xanthan gum premix is added to the water and carbonate. The mixture thickens as it hydrates.

Heating continues and the sodium lauroyl methyl isethionate is added to the mixture. Mixing is performed to provide a homogeneous mixture.

Heating stops and cooling of the batch begins. The anionic surfactant is added to the mixture. Mixing is performed to provide a homogeneous mixture.

The enzymes are added to the mixture. Mixing is performed to provide a homogeneous mixture. The laundry detergent composition has a pH of about 10.25 to 11.5.

Foaming Test and Results

The amount of foam generated by the laundry detergent composition of Example 2 was determined and compared to a laundry detergent composition of a Comparative Example that did not include any foam-reducing components. The compositions are set forth below in Table 3:

TABLE 3

| Component | Example 2 (wt. %) | Comparative Example (wt. %) |
|---|---|---|
| Deionized water | 86.65 | 91.35 |
| Glycerin | 2.0 | 0.0 |
| Xanthan Gum | 0.5 | 0.5 |
| Anionic Surfactant | 0.9 | 0.9 |
| Sodium Lauroyl Methyl Isethionate | 5.75 | 5.75 |
| Propanediol | 0.75 | 0.0 |
| Sodium Carbonate | 2.0 | 0.0 |
| Enzymes | 1.5 | 1.5 |
| Component Totals | 100 | 100 |

25 grams of each laundry detergent composition was weight out in separate beakers. Cold tap water (150 grams) was added to the laundry detergent compositions in each beaker and mixed. Each mixture was poured into a graduated cylinder and then poured back into its beaker, a process that was repeated three (3) times. The height of the foam of each mixture above the liquid level was then measured.

The height of the foam of the laundry detergent composition of Example 2 was 1.5 inches. The height of the foam of the laundry detergent composition of the Comparative Example was 3.75 inches. A greater than 50% height reduction was realized with the laundry detergent composition in accordance with the embodiments of the present principles. Also, the foamy lather present in the mixture of Example 2 had bubbles of relatively larger size and was not dense or creamy in its consistency.

Reference in the specification to "one embodiment" or "an embodiment" of the present principles, as well as other variations thereof, means that a particular feature, structure, characteristic, and so forth described in connection with the embodiment is included in at least one embodiment of the present principles. Thus, the appearances of the phrase "in one embodiment" or "in an embodiment", as well any other variations, appearing in various places throughout the specification are not necessarily all referring to the same embodiment.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

Having described preferred embodiments of laundry detergent compositions that include isethionate surfactants (which are intended to be illustrative and not limiting), it is noted that modifications and variations can be made by persons skilled in the art in light of the above teachings. It is therefore to be understood that changes may be made in the particular embodiments disclosed which are within the scope of the disclosure as outlined by claims appended now or in the future.

What is claimed is:

1. A laundry detergent composition, comprising:

an alkyl isethionate selected from the group consisting of sodium lauroyl methyl isethionate, ammonium cocoyl isethionate, sodium hydrogenated cocoyl methyl isethionate, sodium lauroyl isethionate, sodium myristoyl isethionate, sodium oleoyl isethionate, sodium oleoyl methyl isethionate, and combinations thereof;

a de-foaming agent, wherein the de-foaming agent is a diol, a triol, or a combination thereof; and a coconut fatty acid.

2. The composition of claim 1, further comprising a soluble chloride, salt a carbonate salt, or a combination thereof.

3. The composition of claim 1, wherein the weight-percentage of de-foaming agent is proportional to the weight-percentage of alkyl isethionate, where the ratio of fatty acyl isethionate to de-foaming agent is in the range of about 50:1 to about 1:2.

4. The composition of claim 1, further comprising a fatty alcohol ethoxylate ($RO—(CH_2CH_2O)_n—H$).

5. The composition of claim 4, further comprising a cleaning enzyme.

6. The composition of claim 1, further comprising deionized water.

7. The composition of claim 6, further comprising citric acid, wherein the laundry detergent composition has a pH of less than 7.0.

8. The composition of claim 7, further comprising at least one of a thickener, a preservative, a colorant, a fragrance, and a stabilizer.

9. The composition of claim 8, further comprising at least one additional non-isethionate surfactant.

10. A laundry detergent composition, comprising:

an alkyl isethionate in the range of about 0.1 wt. % to about 99.5 wt. %;

one or more de-foaming agent(s) in the range of about 1 wt. % to about 3 wt. % of the composition, wherein the de-foaming agent is a diol, a triol, or a combination thereof; and a coconut fatty acid.

11. The composition of claim 10, wherein the ratio of alkyl isethionate to de-foaming agent is in the range of about 50:1 to about 1:1.

12. The composition of claim 10, wherein the alkyl isethionate is sodium lauroyl methyl isethionate in the range of about 5 wt. % to about 25 wt. %; and the de-foaming agent is glycerin in the range of about 0.1 wt. % to about 10 wt. %, and propane 1,3-diol in the range of about 0.01 wt. % to about 5 wt. % of the composition.

13. The composition of claim 12, further comprising a cleaning enzyme selected from the group consisting of protease, amylase, pectinase, lipase, and combinations thereof.

14. The composition of claim 10, further comprising a weak organic acid in a concentration to provide a pH in the range of 4.0 to about 6.0 to the composition.

15. The composition of claim 10, wherein the composition has a viscosity in the range of about 1000 centipoises (cps) to about 10,000 cps when measured at a temperature of 25° C.

16. The composition of claim 10, further comprising one or more alkyl polyglycosides (APGs), one or more detergent builders, and one or more anti-redeposition agents.

17. A method of preparing a laundry detergent composition, comprising:

heating deionized water to about 60° C. in a mixing vessel; and adding a fatty alcohol ethoxylate, an alkyl isethionate, glycerol, a coconut fatty acid, a propanediol, and calcium chloride to the heated deionized water in the vessel.

18. The method of claim 17, wherein the fatty alcohol ethoxylate, alkyl isethionate, glycerol, coconut fatty acid, propanediol, and calcium chloride are added sequentially.

19. The method of claim 17, further comprising cooling the composition to about 35° C., and adding a cleaning enzyme and citric acid after cooling.

* * * * *